US005125126A

United States Patent [19]

Bonnant

[11] Patent Number: 5,125,126

[45] Date of Patent: Jun. 30, 1992

[54] HIGH PRESSURE CLEANER EQUIPPED WITH A RECOVERY MEANS FOR THE CLEANING LIQUID AND WASTE

[75] Inventor: Jean Bonnant, Cherbourg, France

[73] Assignee: COGEMA - Compagnie Generale des Matieres Nucleaires, France

[21] Appl. No.: 622,004

[22] Filed: Dec. 4, 1990

[30] Foreign Application Priority Data

Dec. 4, 1989 [FR] France ..... 89 15970

[51] Int. Cl.[5] ..... A47L 11/30; A47L 5/34

[52] U.S. Cl. ..... 15/321; 15/322; 15/353; 15/387; 15/409

[58] Field of Search ..... 15/321, 322, 353, 387, 15/409

[56] References Cited

U.S. PATENT DOCUMENTS

| | | | |
|---|---|---|---|
| 3,705,437 | 12/1972 | Rukavina et al. | 15/322 X |
| 3,720,977 | 3/1973 | Brycki | 15/321 |
| 4,037,290 | 7/1977 | Rose et al. | 15/409 |
| 4,080,104 | 3/1978 | Brown | 15/353 X |
| 4,377,018 | 3/1983 | Cain | 15/322 |
| 4,458,377 | 7/1984 | Frohbieter | 15/321 X |
| 4,595,419 | 6/1986 | Patenaude | 134/1 |
| 4,696,075 | 9/1987 | Grave | 15/321 |
| 4,776,060 | 10/1988 | Chang | 15/353 X |
| 4,809,396 | 3/1989 | Houser | 15/353 X |

FOREIGN PATENT DOCUMENTS 0135978 4/1985 European Pat. Off. .

*Primary Examiner*—Chris K. Moore

[57] ABSTRACT

A high pressure cleaner comprises a cleaning device (10) and an effluent recovery device (12). The cleaning device (10) is mainly constituted by a cleaning head (20) having a central chamber (44) into which a nozzle (26) sprays a high pressure cleaning liquid, the effluents being recovered in a peripheral chamber (46) connected to a decanter (54) of the recovery device (12). The actual decanter (54) is connected to an exhauster (72) across a liquid-gas separator (60) and filters (70). The liquid phase of the effluents is periodically recovered by a tube (80) immersed in the decanter (54) and connected to a hydroejector (82). The solid phase of the effluents is held back by a filter (92) surrounding the tube (80).

13 Claims, 2 Drawing Sheets

Figure 1:
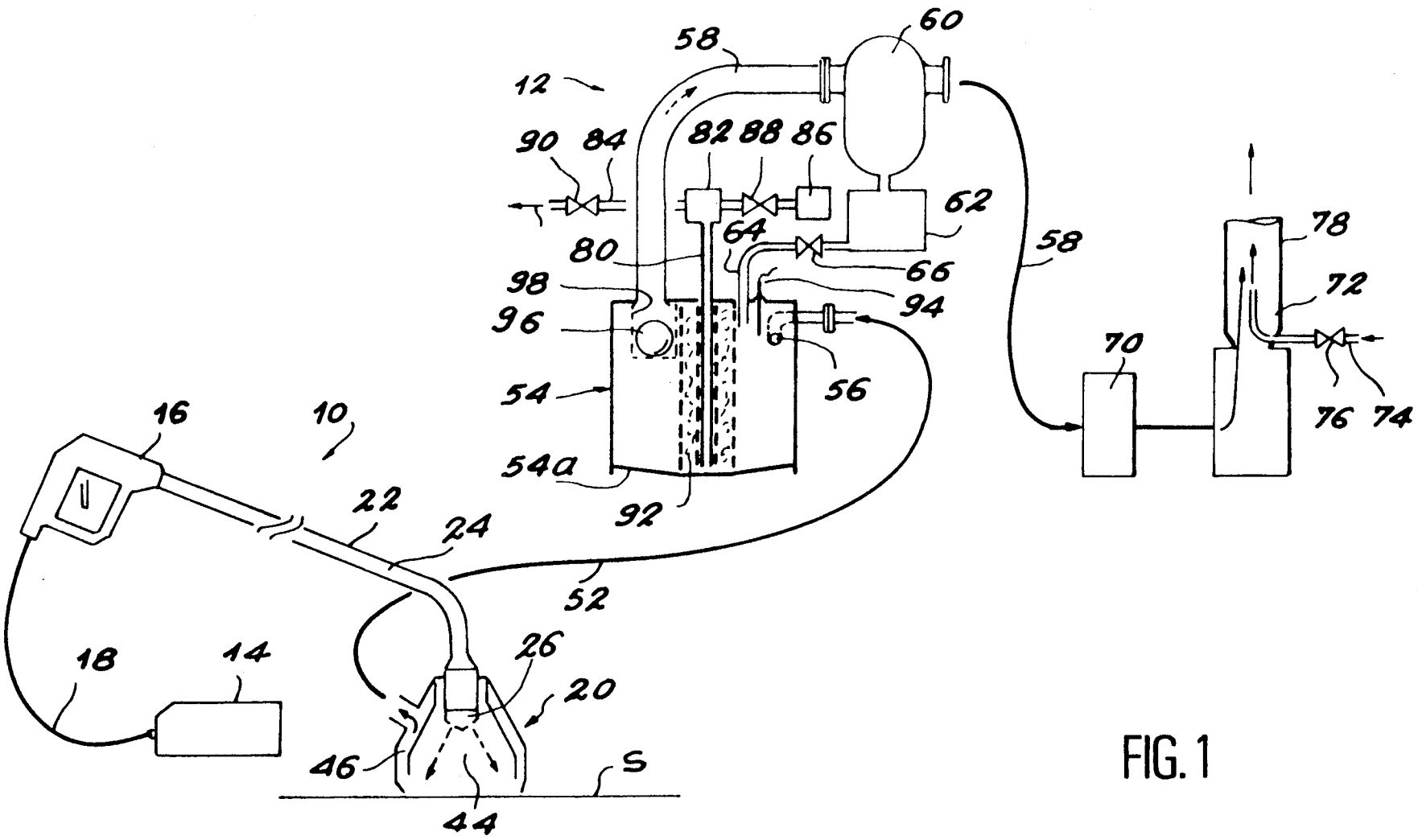

HIGH PRESSURE CLEANER EQUIPPED WITH A RECOVERY MEANS FOR THE CLEANING LIQUID AND WASTE

DESCRIPTION

The present invention relates to a high pressure cleaner designed for carrying out any surface treatment, e.g. on the surfaces of buildings, it being more particularly appropriate for use in a nuclear medium, especially for treating rough concrete surfaces or coverings having no coating and which have been contaminated.

Among the existing methods making it possible to clean rough concrete surfaces or coverings not having any coating in a nuclear medium, not a single one is completely satisfactory.

Thus, a first cleaning method consisting of damaging the surface by means of a demolition hammer suffers from several disadvantages. In particular, the time necessary for destroying the surface is relatively long and the operating equipment and personnel are in direct contact with the contaminated medium. The volume of waste produced causes the problem of removal and also confinement of said waste. Finally, the thus treated surface must be completely made good.

Another known method for cleaning such surfaces consists of using phosphoric or nitric acids. However, this removes all the mechanical strength from the surface. Therefore the surface is deteriorated and must be made good as in the preceding method. There are also the problems of removing the waste and of the direct contact between operating personnel and the medium.

A third known method consissts of cleaning contaminated surfaces by means of a high pressure water jet. Quite apart from the fact that this method also brings the operating personnel into direct contact with the medium, the sprayed water causes the double problem of contaminating uncontaminated surfaces and of its removal. In particular, the structures of certain cells are not suitable for the recovery of effluents and the latter may clog the ground drainage means when the latter exist.

Therefore, in general terms, all the existing methods cause problems in connection with the removal of the waste produced, as well as the radiological safety of the operating personnel.

Outside the nuclear field, U.S. Pat. No. 3,073,727 describes a means for cleaning swimming pools, which has a central chamber into which is introduced an acid for cleaning the pool walls and a peripheral re-suction chamber connected to a pump making it possible to suck up the cleaning liquid without it running the risk of mixing with the water in the pool.

In the said means, which is intent to operate under water, the pump sucks an acid solution, i.e. a liquid medium and nothing is provided for carrying out any treatment on the sucked up solution. Consequently the problem caused by the removal of the waste resulting from cleaning a non-immersed surface by a high pressure water jet is not solved.

The present invention specifically relates to a high pressure cleaner making it possible to clean a non-immersed surface, e.g. in a nuclear medium, whilst ensuring the recovery of the effluents, independently of the nature of the contaminated medium and optionally in a remote manner, e.g. using a telemanipulator.

According to the invention, this result of is achieved by means of a high pressure cleaner having a cleaning head with a central cleaning chamber defined by an intermediate wall and into which issues a cleaning liquid injection pipe, as well as a peripheral chamber for the resuction of the effluents formed between the intermediate wall and an outer wall and into which issues or extends a suction pipe connected to suction or exhausting means, characterized in that the suction means are incorporated into an effluent recovery means comprising a decanter into the upper part of which issues the said suction pipe and a gaseous effluent discharge pipe communicating with the suction means, a liquid effluent discharge pipe connected to pumping means being immersed close to the bottom of the decanter, within an annular filtering member holding back the solid effluents.

In this installation, the passage of effluents through the decanter makes it possible to separate the solids, which must e.g. be stored in containers, from the gaseous and liquid effluents, which can respectively be discharged into the atmosphere and recovered.

Advantageously the decanter is a cylindrical vessel having a vertical axis, the suction pipe extends therein in a circumferential direction, so as to dampen any cyclone effect.

Liquid-gas separating means and filtering means can be placed in the gaseous effluents discharge pipe, a liquid phase recycling pipe connecting a storage container associated with said liquid-gas separating means to the decanter.

The putting into action of the pumping means can be automatically triggered by a liquid high level detector placed in the decanter.

Advantageously, the outer wall of the cleaning head is able to cooperate with a surface to be cleaned by sealing means and the intermediate wall is then spaced from said surface in order to define a passage by which the central cleaning chamber is permanently connected to the peripheral re-suction chamber.

In order to increase the cleaning efficiency, the injection pipe issues into the cleaning chamber by a rotary nozzle, whose rotation is controlled by the flow of the cleaning liquid, said nozzle having at least two orifices oriented in such a way that the jets from said orifices strike the surface to be cleaned in the immediate vicinity of the passage.

The security of operating personnel is improved advantageously by connecting the cleaning head to a control gun by a manipulating pole constituting the injection pipe, a high pressure generator supplying cleaning liquid to the control gun.

A preferred embodiment of the invention is described in greater detail hereinafter relative to the attached drawings, wherein show:

FIG. 1 a diagrammatic view, partly in section, showing a high pressure cleaner constructed according to the invention.

Figure 2:
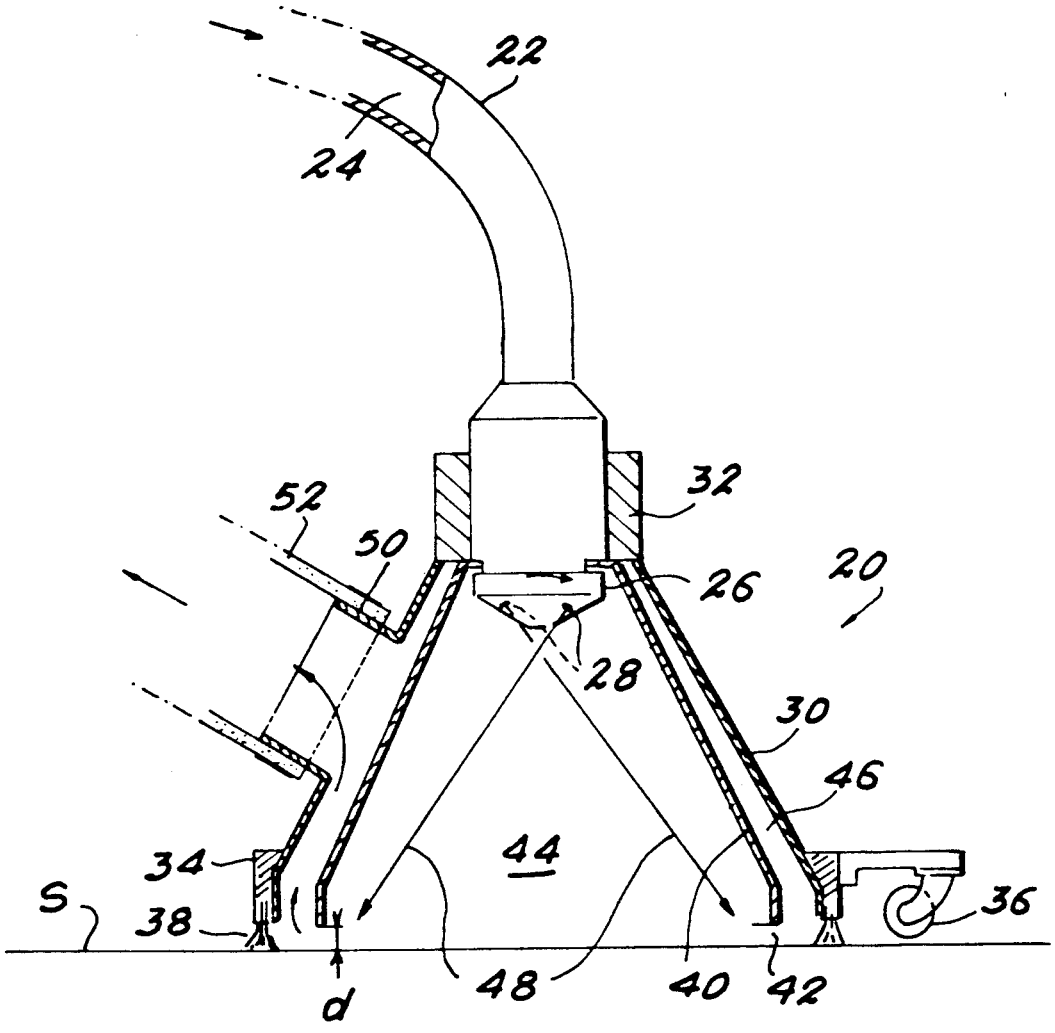

FIG. 2 a larger-scale sectional view of the cleaning head of the cleaner of FIG. 1.

On referring firstly to FIG. 1, it can be seen that the high pressure cleaner according to the invention mainly comprises a cleaning means generally designated by the reference 10 and an effluent recovery means designated by the general reference 12.

The cleaning means 10 comprises a conventionally designed high pressure generator 14 supplying water under high pressure, which is fed to a control gun 16 across a flexible tube 18. The control gun 16 is connected to a cleaning head 20 by a rigid manipulating pole 22, whose length can e.g. be at least 1.50 m. The manipulating pole 22 internally defines a pressurized water injection pipe 24, whose water supply is controlled by a control member, such as a trigger on the control gun 16.

On referring to FIG. 2, it is possible to see that the end of the manipulating pole 22 supporting the cleaning head 20 is provided with a nozzle 26 through which the injection pipe 24 defined within the pole 22 issues into the cleaning head 20. More specifically, the nozzle 26 is mounted for rotation on the end of the manipulating pole 22 and has two orifices 28, whose orientation is inclined with respect to the axis of the nozzle, which has the effect of automatically rotating the nozzle 26 when the high pressure water is admitted into the injection pipe 24.

The manipulating pole 22 is bent in the vicinity of its end carrying the cleaning head 20, in such a way that the latter can easily be applied to a surface S to be cleaned when the gun 16 is held by an operator.

The cleaning head 20 essentially has a substantially truncated cone-shaped, outer wall 30, whose smaller diameter end is fixed to the end of the manipulating pole, e.g. by a base 32. The opposite end of the truncated cone-shaped, outer wall 30 is open and is externally reinforced by a ring 34, on which are mounted three rollers 36, which can be applied to the surface S to be cleaned and whereof only one is shown in FIG. 2. On the side of the surface S, the ring 34 also supports an annular sealing member 38, e.g. constituted by a brush or blade making it possible to confine the volume defined within the wall 30 with respect to the outside of said wall.

The cleaning head 20 also comprises a substantially truncated cone-shaped, intermediate wall 40 placed within the volume defined by the outer wall 30 and whose smaller diameter end is fixed to the base 32 around the rotary nozzle 26.

The larger diameter end of the intermediate wall 40 is open and located at a given distance d from the surface S to be cleaned, when the rollers 36 are in contact with the said surface. Thus, between the edge of the intermediate wall 40 adjacent to the surface S and said latter surface, is defined an annular passage 42 by which a central cleaning chamber 44 formed within the intermediate wall 40 permanently communicates with a peripheral, effluent re-suction chamber or effluent suction chamber 46 formed between the intermediate wall 40 and the outer wall 30.

As is diagrammatically illustrated by the arrows 48 in FIG. 2, the high pressure water jets passing out of the orifices 28 of the rotary nozzle 26 strike the surface S to be cleaned in the immediate vicinity of the passage 42, i.e. in the vicinity of the larger diameter end of the intermediate wall 40. In this way, it is clear that the recovery of the effluents constituted by the water and the waste resulting from the cleaning of the surface S takes place in an easy manner through the passage 42 and then the chamber 46. In order to allow said recovery, the outer wall 30 has a tube 50 to which is connected a suction pipe, constituted by a flexible tube 52.

On again referring to FIG. 1, it can be seen that the opposite end of the flexible tube 52 is connected to the waste recovery means 12, which will now be described. The recovery means 12 firstly comprises a decanter 54 advantageously constituted by a, cylindrical vessel having a vertical axis, whose bottom 54*a* slopes slightly towards the axis of the said vessel. The decanter or vessel 54 is tight and if cylindrical wall is traversed, in the vicinity of its upper end, by an effluent supply tubule 56 to which is connected the flexible tube 52. More specifically, the end of said tubule 56 located within the decanter 54 is curved in in a substantially circumferential direction, so as to start a cyclone effect when the effluents arrive in the decanter through the flexible tube 52.

A gaseous effluent discharge pipe 58 also issues into the upper part of the decanter 54, through the cover of the latter, at a location substantially diametrically opposite to the tube 56. Said pipe 58 is extended up to a pneumatic exhauster or suction means 72, while successively traversing a water separator 60 and filters 70.

Within the water separator 60, the liquid microdroplets entrained by the air flow are separated from the latter and recovered in a storage container 62. The latter is placed at a higher level than that of the decanter 54 and is connected to the latter by a recycling pipe 64 controlled by a normally closed valve 66. The pipe 64 tightly traverses the cover of the decanter 54 and issues into the bottom of the storage container 62, in such a way that the latter is automatically drained into the decanter on opening the valve 66. The filters 70 are nuclear quality filters used for holding back any solid particles entrained by the gaseous effluents.

The pneumatic exhauster 72 functions by the venturi effect, by means of a compressed air injection pipe 74 controlled by a valve 76. The effect of opening said valve is to inject compressed air into the exhauster 72, which creates a vacuum as a result of which the effluents from the cleaning head 20 are sucked up by the peripheral chamber 46, the suction chamber 52, the decanter 54 and the pipe 58 and pass through the separator 60 and the filters 70. The compressed air injected into the exhauster 72 by the pipe 74 mixes with the air sucked in by the pipe 58 and is then discharged to the outside through a tube 78.

The part of the recovery means 12 described hereinbefore makes it possible, as a result of the exhauster 72, to create an adequate vacuum for sucking in the effluents produced by the cleaning head 20, i.e. the cleaning liquid and the waste resulting from the impact of said liquid on the surface S. These effluents, which contain both a gaseous phase, a liquid phase and a solid phase, are firstly separated in the decanter 54, which retains most the liquid and solid phases. The small part of the liquid phase remaining in the gaseous phase is recovered by the separator 60 and the small part of the solid phase remaining in the gaseous phase is recovered by the filters 70.

The recovery means 12 also makes it possible to separate the liquid and solid phases held back in the decanter 54. To this end, a vertical tube 80 arranged along the axis of the decanter 54 tightly traverses the cover of the latter and is immersed down to the vicinity of its bottom 54*a*. At its upper end said tube 80 communicates with a hydroejector or hydraulic ejection device 82 placed in a circuit 84, connected upstream of the hydraulic ejection device 82, to a pressurized water source 86. Normally closed valves 88 and 90 are placed in the circuit 84 respectively upstream and downstream of the hydraulic ejection device 82. During the opening of the valves 88 and 90, this arrangement makes it possible to suck in the liquid contained in the decanter 54 in order to e.g. recycle it.

In order that the liquid sucked in by the tube 80 is separated from the solid phase also deposited in the decanter 54, the latter contains an annular filter 92, which is e.g. made from compressed polyester wool, which extends over the entire height of the decanter around the tube 80. The said filter 92 can be placed between two concentric, perforated metal sheets, which fulfil a mechanical holding function without preventing the water flow.

As a result of this arrangement, large dirt particles settle at the bottom of the decanter 54 and the water migrates through the filter 92, which only offers a little resistance to the water, but still retains the dirt. Thus, the tube 80 only sucks in the water containing very fine particles.

In order to allow the drainage of the water contained in the decanter 54, it is necessary to stop the exhauster 72. Consequently the valves 88 and 90 controlling the suction of the water recovered in the decanter 54 are normally closed when the exhauster 72 is operating. When the decanter 54 is full of water, the valve 76 controlling the operation of the exhauster 72 is closed before the valves 88 and 90 are opened.

Preferably, a high liquid level detector 94 is positioned in the upper part of the decanter 54 and this can be connected to an alarm notifying the operator of the need to drain the decanter, or which can automatically trigger the closing of the valve 76 followed by the opening of the valves 88 and 90, thereby automating the operation of the cleaner.

In the embodiment illustrated in FIG. 1, there is also a safety device making it possible to automatically close the inlet of the pipe 58 by which air suction takes place outside the decanter, in the case where the level detector 94 is defective and also in order to obviate the effects of an alarm triggered by said detector being ignored. This safety device comprises a floating ball 96, which is placed in a perforated cage 98 located in the extension of the pipe 58, immediately below the cover of the decanter 54. When the level in the decanter 54 rises abnormally, the floating ball 96 closes the lower end of the pipe 58. The vacuum created by the exhauster 72 then keeps this ball in the position closing the pipe 58 and suction stops in the peripheral re-suction chamber 46 of the cleaning head 20.

As a result of the presence of the recovery means 12, the high pressure cleaner according to the invention makes it possible to solve in a simple and effective manner the problem caused by the waste produced by the recovery means. Moreover, said waste is separated as a function of the nature thereof, so that certain waste can be recycled or discharged without any risk to the operating personnel.

Moreover, the design of the cleaning means 10 enables the operating personnel to work at a relatively great distance from the surface to be cleaned and even allows said personnel to be replaced by a remote handling device such as a telemanipulator.

It is also of interest to observe that the high pressure cleaner accorrding to the invention can be used no matter what the nature of the medium which it is wished to clean, because the separation of the different phases carried out in the recovery means 12 makes it possible to particularly effectively check the control of the effluents.

Finally, said means has the advantage of all existing high pressure cleaners, i.e. that of not deteriorating the thus cleaned surfaces, which obviates the need to make good said surfaces after intervention has taken place.

Obviously, the invention is not limited to the embodiment described in exemplified manner hereinbefore and covers all variants thereof. Thus, it is readily apparent that the recovery means described can be used with a high pressure cleaner having a cleaning head with a slightly different structure to that described. In the same way, the means used for separating the different recovered effluent phases can undergo certain modifications without passing outside the scope of the invention.

I claim:

1. A high pressure cleaner having a cleaning head incorporating a central cleaning chamber defined by an intermediate wall and a pipe extending therein for injecting a cleaning liquid, and a peripheral effluent re-suction chamber formed between the intermediate wall and an outer wall and a suction pipe extending therein connected to suction means, said suction means being incorporated into an effluent recovery means, which comprises a decanter into the upper part where said suction pipe extends and a gaseous effluent discharge pipe communicating with the suction means, a liquid effluent discharge tube connected to pumping means being immersed close to the bottom of the decanter, within an annular filtering member holding back the solid effluents, and wherein the gaseous effluent discharge pipe comprises liquid-gas separating means and filtering means.

2. Cleaner according to claim 1, wherein the decanter is a cylindrical vessel having a vertical axis, the suction pipe extending into said vessel in a tangential direction, so as to start a cyclone effect.

3. Cleaner according to claim 1, wherein the liquid-gas separating means communicate with a water storage container connected to the decanter by a recycling pipe normally closed by a valve.

4. Cleaner according to claim 1, wherein the pumping means comprise a hydraulic ejecting device placed in a circuit connected to a pressurized liquid source and equipped with normally closed valves located upstream and downstream of the location where said hydraulic ejecting device is placed in said circuit.

5. Cleaner according to claim 1, further comprising a high liquid level detector which is placed in the decanter.

6. Cleaner according to claim 5, wherein the high liquid level detector controls, when it is operated, the stoppage of the suction means.

7. Cleaner according to claim 1, further comprising float closing means which is placed in the decanter, at the inlet of said gaseous effllluent discharge pipe, in order to automatically close the latter when the liquid in the decanter exceeds a given high level.

8. Cleaner according to claim 1, wherein the outer wall of the cleaning head adapted to cooperate with a surface to be cleaned by sealing means and the intermediate wall is then removed from said surface in order to define a passage by which the central cleaning chamber permanently communicates with the peripheral re-suction chamber.

9. Cleaner according to claim 8, wherein the outer wall carries rollers which can be applied to the surface to be cleaned, in order to maintain the width of said passage constant.

10. Cleaner according to claim 8, wherein the injection pipe issues into the cleaning chamber by a rotary nozzle, whose rotation is controlled by the cleaning liquid flow.

11. Cleaner according to claim 10, wherein the rotary nozzle has at least two orifices oriented in such a way that the jets coming from said orifices strike the surface to be cleaned in the immediate vicinity of said passage.

12. Cleaner according to claim 8, wherein the cross-section of said passage is approximately equal to the re-suction pipe section.

13. Cleaner according to claim 1, wherein the cleaning head is connected to a control gun by a manipulating pole constituting the injection pipe, said control gun being supplied with cleaning liquid by high pressure generator.

* * * * *